United States Patent [19]

Grass

[11] 4,400,848

[45] Aug. 30, 1983

[54] DOOR HINGE WITH A SLIDING CATCH

[76] Inventor: Alfred Grass, Konsumstrasse 20, A-6973 Höchst/Vlbg.-Österreich, Fed. Rep. of Germany

[21] Appl. No.: 236,551

[22] Filed: Feb. 20, 1981

[30] Foreign Application Priority Data

Oct. 25, 1980 [DE] Fed. Rep. of Germany ..... 3040287

[51] Int. Cl.[3] ..... E05D 7/00; E05D 11/10

[52] U.S. Cl. ..... 16/332; 16/379; 16/374

[58] Field of Search ..... 16/379, 327, 332, 297, 16/287, 288, 249, 374

[56] References Cited

U.S. PATENT DOCUMENTS

| | | | |
|---|---|---|---|
| Re. 28,786 | 4/1976 | MacDonald . | |
| 403,494 | 5/1889 | Streeter . | |
| 621,192 | 3/1899 | Whipple . | |
| 1,122,322 | 12/1914 | Smith . | |
| 2,656,563 | 10/1953 | Jones . | |
| 2,874,609 | 2/1959 | Ducati . | |
| 3,835,585 | 9/1974 | Anderson et al. . | |
| 4,083,082 | 4/1978 | Holmes | 16/288 |
| 4,166,307 | 9/1979 | Rock et al. | 16/288 |
| 4,227,284 | 10/1980 | Zernig | 16/249 X |

FOREIGN PATENT DOCUMENTS

| | | | |
|---|---|---|---|
| 653160 | 9/1964 | Belgium . | |
| 1804827 | 5/1970 | Fed. Rep. of Germany | 16/327 |
| 2818735 | 11/1979 | Fed. Rep. of Germany | 16/332 |

*Primary Examiner*—Werner H. Schroeder
*Assistant Examiner*—Andrew M. Falik
*Attorney, Agent, or Firm*—Parmelee, Miller, Welsh & Kratz

[57] ABSTRACT

A door hinge for furniture is made up of a box-like part designed to be set within or inset into a recess in a door from its back side, and has a spring-powered or pressed bolt for acting on a cam face at the end of an L-like support arm. The arm is fixed to the body or frame of a piece of furniture so that in one (or two) positions where the cam face has an inwardly offset of cut-out portion, the bolt will be responsible for a detent effect to keep the door in a shut position or in shut and or open positions. The L-like support arm is fixed to the body of the piece of furniture by way of a base or mounting plate having a guiding mounting ledge for cooperating with one leg of the support arm. The one leg portion has a wedging face and is responsible for guiding the support arm parallel to itself for changing the height of the arm. The arm is mounted on the base plate in position for normal use by a metal screw or the like. For limiting opening of the door, a box for the hinge has a limiting or stop face designed to abut against a face of the support arm.

7 Claims, 12 Drawing Figures

DOOR HINGE WITH A SLIDING CATCH

CROSS REFERENCE TO RELATED APPLICATION

The invention is with respect to a hinge system which in some respects is like that of my U.S. application Ser. No. 149,275 of May 12, 1980.

BACKGROUND OF THE INVENTION

1. Field of the Invention

The present invention deals with a door hinge system for producing a door shutting force and, if desired (in another part of the range of turning of the door), a door opening force, for the purpose, at least, of keeping, and possibly of moving, the door into a shut position (or, in the other case, into shut and open positions), as desired.

The door hinge of the invention has a support arm fixed to a piece of furniture or the like as, for example, its frame, having a cam on its free end acted upon by a spring-powered bolt. The bolt is movingly housed in the other part of the piece of furniture, for example, the door; the cam produces a turning force to keep the door in a given position, that is to say, at least in a shut position.

2. Description of the Prior Art

A construction for a door hinge design on these lines has been made in my U.S. patent application Ser. No. 149,275 which has not been prior-published. In the case of this earlier system, the part, taking up the force producing unit (the spring and spring-powered bolt) of the hinge box is set or mounted in the door from its front side. The axis of the force producing unit, that is to say, the line along which the unit takes effect, is at an angle to the plane of the door. This may be a shortcoming in its use, since the structure generally takes up so much space that, in the shut position of the door, parts (more specially the support arm) of the hinge structure have to be taken up within space inside of the piece of furniture or frame assembly.

One purpose of the present invention is that of making such a further development of the system of said U.S. patent application Ser. No. 149,275 that in the shut position of the door no parts of the hinge system will take up space within the piece of furniture, while at the same time, the system for limiting turning of the door in relation to the frame of the piece of furniture is efficient so that, on opening the door, no damage to the hinge is likely.

SUMMARY OF THE INVENTION

For effecting the above-mentioned and other purposes, an improved hinge of the present invention is characterized in that between the hinge box and the support arm there is a stop face for limiting the angle of opening and, in that the support arm which is adjustable in height together with the force producing unit, are completely turned into and taken up within the hinge box when the hinge is in the shut position.

Also a key feature of the present invention is that between the hinge box and the support arm there is a limit or stop face for marking the end of the opening angle of the system which has the effect of limitng the turning angle of the door in the opening direction in the desired way. In this case there will no longer be any need for stops placed at other positions between the door and the frame of the furniture, because the stop for limiting the turning motion of the door is now, as part of the invention, made part of the door hinge, itself.

BRIEF DESCRIPTION OF THE DRAWINGS

To give a clearer picture of the invention, an account will now be given of a single working example or embodiment to be seen in the figures, the account and the figures at the same time giving details of further useful effects and properties of the invention.

DESCRIPTION OF THE PREFERRED EMBODIMENTS

Figure 1:
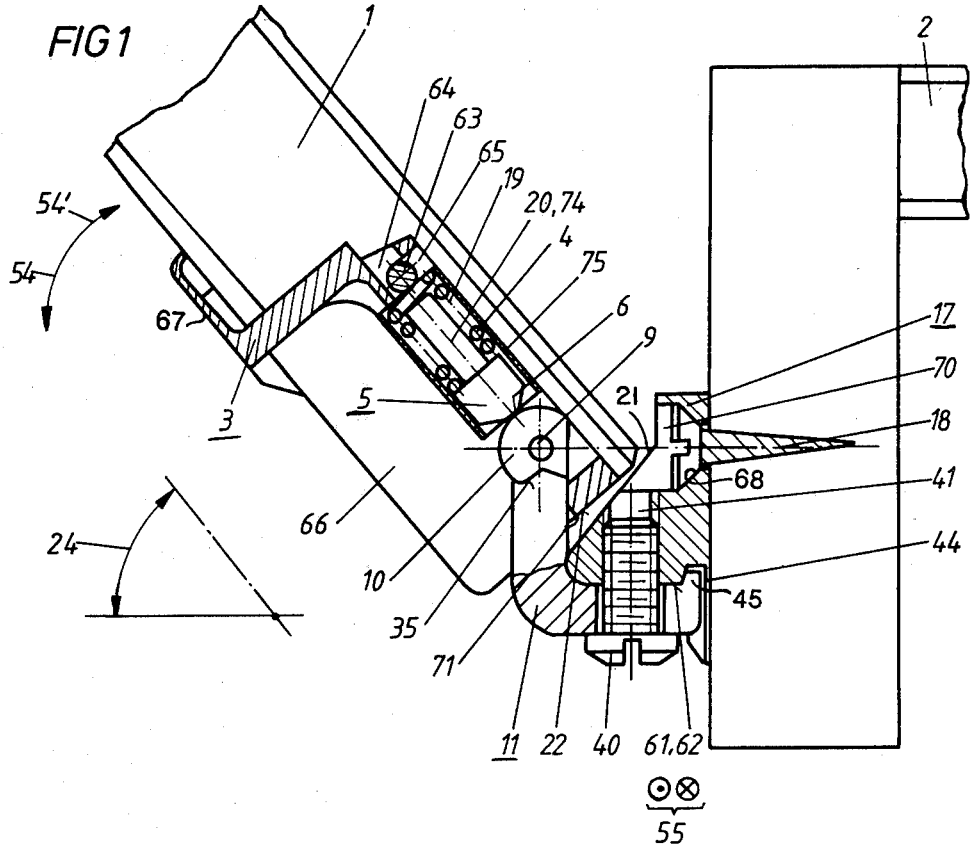
FIG. 1 is a section through a mounted door hinge of the invention running through the middle of the hinge in its length direction, the hinge being in an open position.
Figure 2:
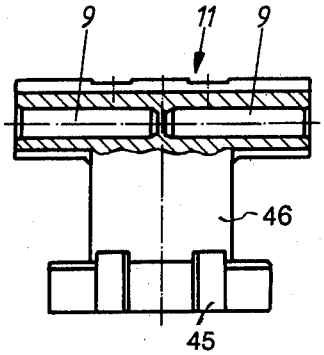
FIG. 2 is a part-section of the support arm of FIG. 1.
Figure 3:
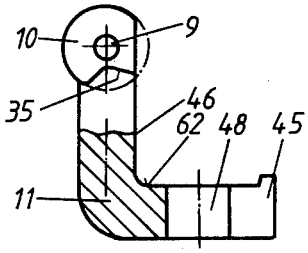
FIG. 3 is a partly sectioned side view of the support arm.

A hinge box 3 is set into the back side of a door 1 as will be seen in FIG. 1. Hinge box 3 has holes 14 (see FIGS. 1, 2 and 5) for taking up different ones of two pivot or turn pins 9, whose other ends are placed in different holes in a support arm 11. The form of the support arm 11 will be seen from FIGS. 2 and 3; it is fixed to a base, mounting or fixing plate 17, so that it may be adjusted in height (such adjustment being marked by arrows 55 of FIG. 1 by easing it off somewhat and then tightening it up again). For its part, base or fixing plate 17 is fixed or mounted by screws 18 to the frame or body 2 of a piece of furniture with which the door is used.

Figure 4:
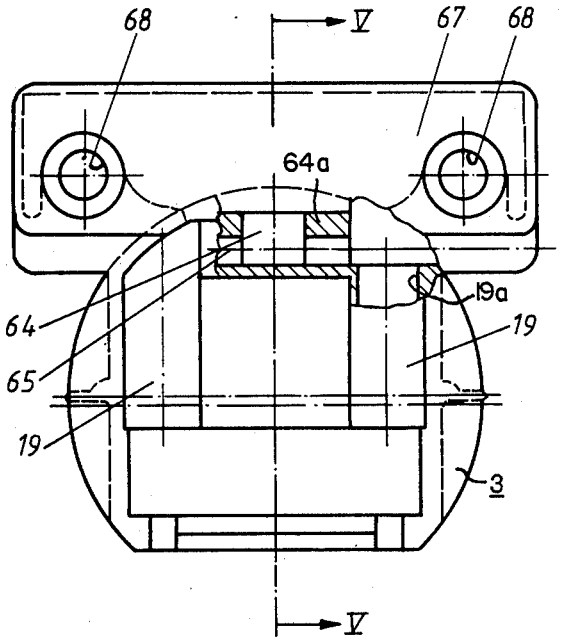
FIG. 4 is a view of the hinge box of FIG. 1 as seen from the back and as partially broken away.
Figure 5:
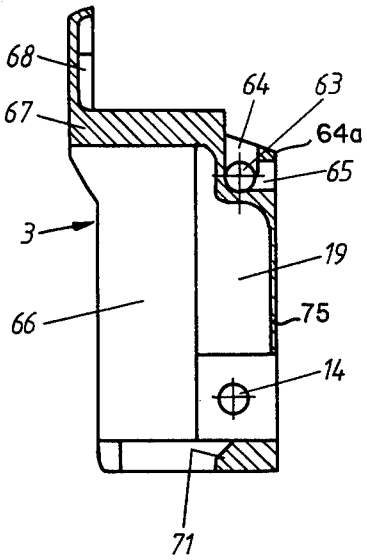
FIG. 5 is a section on the line V—V of FIG. 4.
Figure 6:
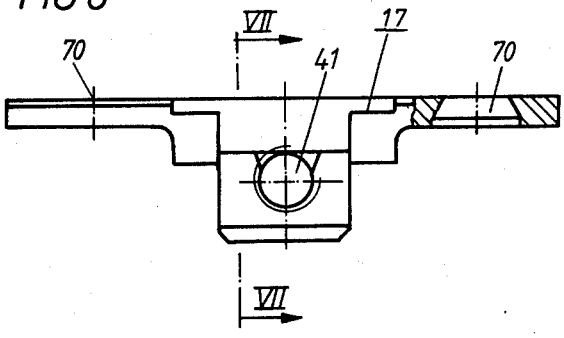
FIG. 6 is a front view of the base plate of the construction of FIG. 1.

As will be seen in FIGS. 4 and 5, hinge box 3 has holes 68 in its face plate 67, so that it may be mounted on (as by bolts or screws) or fixed to the inner side of the door 1.

Figure 10:
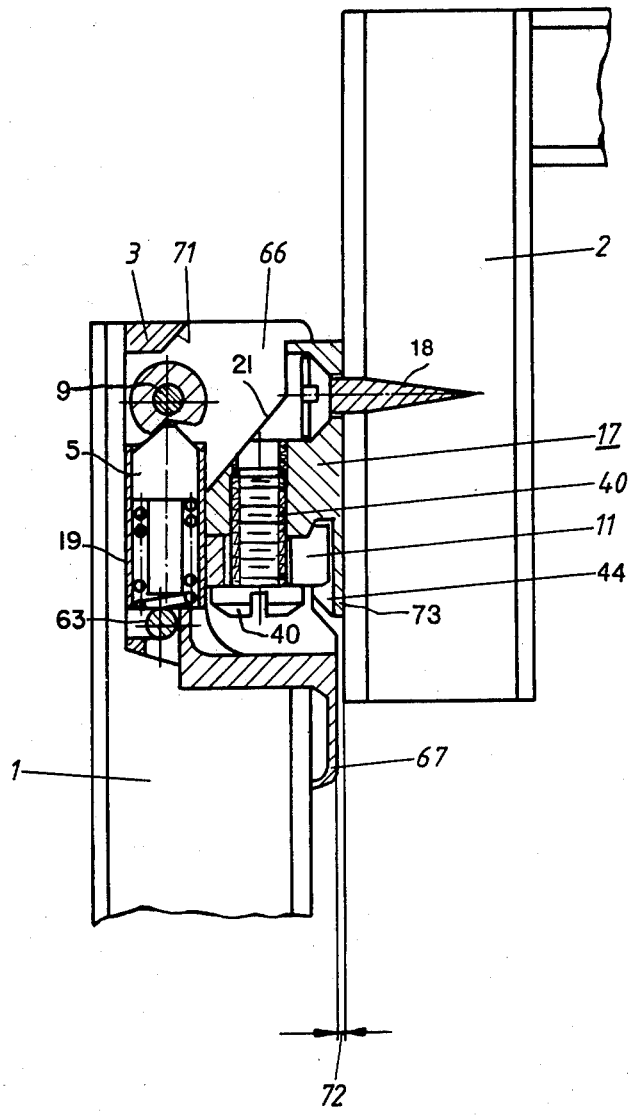
FIG. 10 is a section through the middle of the door hinge of FIG. 1, running through its length, and in the shut position of the door.

The hinge has a force producing unit which, as will be seen in the use of cam 10 on one end of the support arm 11, is responsible for producing a force in the illustrated shut position of the door of FIG. 10, and further (given the right design of cam 10), in its open position. The force producing unit is made up of a bolt 5, powered by a helical spring 4. The bolt 5 has a tail piece or pin end portion 20 and a cam head which is of greater diameter than the tail piece. The force means or helical spring 4 flexibly urges a point end 6 of the bolt head 5 against the outer face of the cam 10 on an end of the support arm 11.

Figure 11:
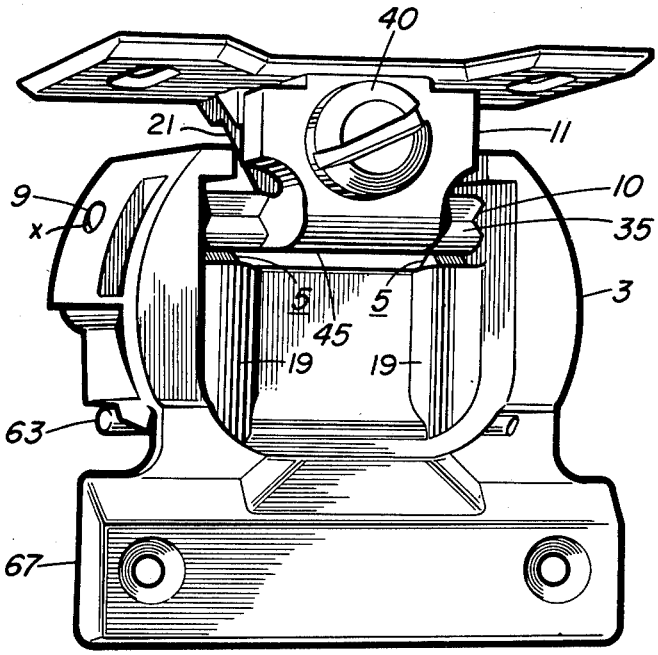
FIG. 11 is an isometric perspective view of the hinge of the invention in its assembled and operative relation.
Figure 12:
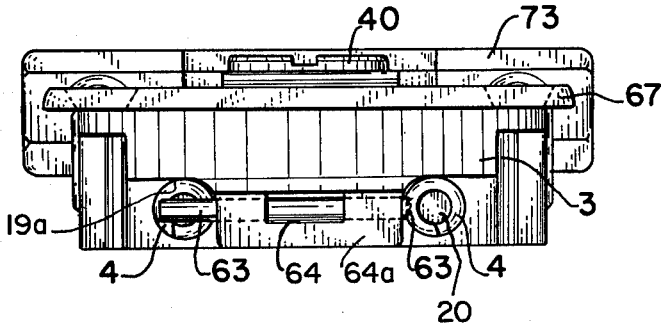
FIG. 12 is a back end view in elevation on the same scale as and of the hinge shown in FIG. 11.

In the hinge box 3, the bolt 5 and its tail piece 20 serve as a position-retaining force-producing unit together with a helical spring 4. It will be seen from FIGS. 4, 5 and 12 that the hinge box 3 has a middle, sight opening 64 in a centrally located bifurcated end portion 64*a*. It will also be seen that each bolt 5 and its associated spring 4 are operatively carried in a substantially concealed relation within an open-end bore 19*a* of a bore wall 19 (see also FIG. 11). A pair of bore walls 19 extend along the inside of the base plate 3 in a spaced-apart relation with respect to each other. As shown particularly in FIGS. 4 and 12, each bolt 5 and its spring 4 constitute spring-pressed latch means that is operatively positioned within an associated bore wall 19 to engage the cam 10 through one (a front or inner) open end of its bore 19*a* and, at its opposite (back or outer) open end, to be held in an operating position by engagement with a cross-extending back-up or keeper pin 63. In FIG. 12, the right hand end of the pin 63 has been broken away to show the spring 4 and the tail piece 20 of one force producting unit. The pin 63 is carried by a bifurcated back end portion 64*a* of the hinge box 3 to engage the back end of each spring 4.

The keeper pin 63 is positioned to extend along a cross-extending hole 65 that projects through the bifurcated portion 64*a* at the back end of the hinge box. Also, the keeper pin 63 may be further secured in position by gripping its end with bent-over ears or by the use of a cotter pin or set screw. When the keeper pin 63 is endwise removed, this permits the insertion and removal of the latching means assembly consisting of the helical spring 4 and the bolt 5. It will thus be apparent that each assembly can be inserted within and removed from its associated bore hole 19*a* by removal of the keeper pin 63 endwise out of its positioning hole. In the working assembly shown, two parallel pressure producing units (see FIGS. 4 and 11) are shown as placed in a spaced-apart, sidewise parallel relation within the hinge box 3.

Because the lengthwise axis 74 (see FIG. 1) of each force producing unit 4, 5, 20, as positioned within its associated bore wall 19, is parallel to and extends along opposite inside walls of and near the floor 75 of the hinge box 3, the assembly takes up very little space. It is thus possible to have a space 66 (see FIG. 5) for taking up the support arm 11 and a threaded gripping or mounting screw 40 for height adjustment when the hinge is in its shut position (see FIG. 10). As will be seen in FIG. 10, the parts or elements noted are positioned completely within the space 66 of the hinge box 3 when the door 1 is shut.

Because the lengthwise or longitudinal axis 74 of the force producing unit is near the back wall or floor 75 of the hinge box 3, there is the further important useful effect that, at the same time, hinge turn up or pivot axis 9 of the hinge box 3 and of the support arm 11 may be placed near the floor 75 of the hinge box. The designing of an L-like or angle-shaped, connecting swing support arm 11 is best made with an angle of 90° between its two parts, legs or spaced-apart end portions (see FIG. 3). There will be the useful effect that a front end abutment face 22 (see FIG. 1) of the hinge box 3 that is perpendicular to the back side of the door 1, will take the form of a stop face 71 for limiting the opening motion of the door to an angular position in the direction of the arrow 54'. In this respect, the hinge is shown in FIG. 1 as open past a right angle by the angle 24, and as limited by engagement of the face 22 with an inclined back abutment face 21 of the base plate 17. As also shown in FIG. 1, the door 1 is thus limited to a spaced, angular, maximum open position with respect to the frame 2 to thus prevent them from making damaging engagement with respect to each other, and to also retain the cooperating surfaces of the bolts 5 and the cam 10 in a suitable operating relation with respect to each other.

The fixing plate may be a cast metal part, made of brass or zinc alloy, or of a low-price part made by stamping and being sheet steel. The guiding face is formed between the outer radius of bending and the end face of the fixing or base plate.

Because the force producing unit generally is housed so as to be parallel to and near the floor on bottom of the hinge box within the same, a different sort of system for locking the helical spring is necessary. The bolt of the force producing system has to be put into position from the back in a direction parallel to the floor of the hinge box into the same. As a keeper for the helical spring and for shutting off the inlet end of the spring hole, use is made of a keeper pin which is slipped into a hole or a slot in the hinge box and locked in position in it.

Figure 7:
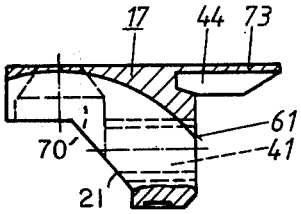
FIG. 7 is a section on the line VII—VII through the base plate or fixing plate of FIG. 6.
Figure 8:
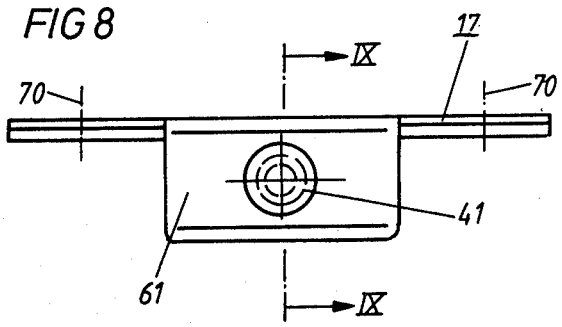
FIG. 8 is a view of the back of the base plate, which is shown in FIGS. 6 and 7.
Figure 9:
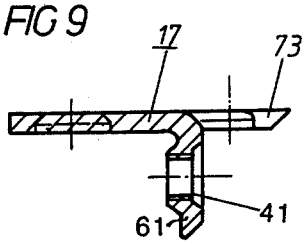
FIG. 9 is a section on the line IX—IX of FIG. 8 through the base plate.

In another form of the invention it is possible to make use, furthermore, of two pins in which respect the force producing unit will then be made up of two helical springs, placed side by side in parallel to each other, each with its own bolt for acting on the cam, with each helical spring having its own backup or keeper pin. For keeping the backup pins in position, it is furthermore possible to make use of set screws which are screwed into the hole housing the spring. It would furthermore be possible to make use of bent-over sheet metal ears or thin pieces of the wall of the housing of of guiding face 62. The right hand leg 45 is angled so as to become narrower in a direction away from the arm and is adapted to fit or latch within a groove 44 (see FIG. 7) in the base plate 17. Such grooved portion has the same angle and forms a part of a guiding face 61 which is complementary to the leg 45 of the arm 11.

Threaded mounting screw 40 is in this respect placed to extend through a hole 48 in the leg 45 (see FIGS. 1 and 3) of the support arm 11. The threaded stem of the screw 40 is entered in a threaded hole 41 in the base or mounting plate 17 (see FIGS. 6 through 9, inclusive).

On loosening gripping or mounting screw 40 somewhat, it becomes possible for the support arm 11 to be moved in the direction of arrows 55 of FIG. 1 back and forth along and with respect to the base plate 17, normal to the plane of the paper.

After adjustment as to the height of the door 1 in relation to frame 2, gripping screw 40 may be tightened up again. This produces a very strong and mechanically resistant seating effect between the two guiding faces 61, 62 of support arm 11 and base plate 17.

As will be seen from FIGS. 6 to 9, base plate 17 is in the form of a plate-like part which may be produced by casting metal or stamping and bending steel sheet. Countersunk threaded hole 41 is placed in the middle of guiding face 61. It will be apparent from FIGS. 7 and 9 that on one side there is an ear 73 next to the guiding face 61. This ear 73 is used for spacing the hinge box in relation to the base plate 71 in the shut position of the door (FIG. 10) to keep it clear of the frame 2.

The base plate 17 is shown fixed to the body or frame 2 by two screws 18 (see FIGS. 1, 6, 8 and 10) that extend through holes 68 in the side of the base plate and clear of the arm 11. A slot or groove 44 is formed in an ear 73 of the base plate 17 to receive the leg or ledge portion 45 of support arm 11 (see FIGS. 1 and 10). Due to the design of the ear 73 with its hollowed out form, the face of the hinge box 3 which is screwed against the door by wood or metal screws and the base plate 17 are truly parallel in the shut position of the door hinge (see FIG. 10). In this position, the support arm 11 is furthermore substantially fully taken up or enclosed within the space 66 of the hinge box 3.

The face of the ear 73 which is screwed against the frame or body of the piece of furniture, is some tenths of a millimeter past the plane of the outer face of hinge box 3 in the closed position of the door 1 (FIG. 10); this distance is indicated as 72 on such FIGURE. For this reason, the door hinge may be changed in position on the front frame side of the frame or body 2 and then be fixed in a desired position. Shutting of the door out of the open position of FIG. 1 into the shut position of FIG. 10 and vice versa, takes place in the direction of arrows 54 and 54' of this FIGURE.

Referring particularly to FIGS. 1 and 10 of the drawings, it will be seen that one end or leg portion of the support arm 11 is pivotally secured within the box by the pin 9, while the other leg or end portion is fixedly secured to the mounting plate 17 by the screw 40 that extends somewhat loosely therethrough and is threadably mounted within an outer projecting portion of the mounting plate 17. The mounting plate 17 and the forward end or arm portion of the support arm 11 have somewhat complementary cooperating guide-slide portions that enable a keyed parallel sliding adjustment therebetween. This mounted relation between the screw 40 and the support arm 11 thus enables a transverse or height adjustment of the support arm with respect to the mounting plate when the screw 40 is loosened.

The spring-pressed bolt 5 is shown provided with a shaped head or face that is adapted to ride along the curved portion of the cam 10 of the support arm and, under some pressure exerted by the cooperating spring 4, provides any desired resistance to an open and closing movement of the door. The inset notch portion 35 of the face of the cam 10 serves as a latching portion with the somewhat ridge-like peak or pointed end 6 of the bolt head to thus provide a greater resisting force to opening of the door when these two portions are in the aligned latching relation of FIG. 10. It is important that the spring-pressed bolt assembly as well as the pivot connected end portion of the support arm are mounted along or adjacent to the back wall of the hinge box 3. Importantly, as shown in FIG. 10, when the door 1 is fully closed, the support arm 11 and the screw or removable mounting means 40 are fully enclosed within the open side of the hinge box 5 and substantially major portions of the base or mounting plate 17 are also enclosed within confines of the box 5. The cam 10 may have a flat face portion as shown in FIG. 1 or a fully rounded portion as shown in FIG. 10.

By a special design of the support arm, and more specially by positioning the force producing unit, responsible for the shutting or, if necessary, the opening force, in the hinge box, it is now possible to make certain, as part of the present invention, that the complete force producing unit, together with the support arm, is completely taken up within, and turned into the hinge box when the door hinge is in the shut position; this greatly decreases the amount of space needed for the hinge because, as part of one line of reasoning and development of the present invention, a hinge box is put forward taking up little space and into which all parts are placed on turning motion of the hinge structure into the door's shut position.

As a further development of the invention, the force producing unit is so placed as to have a common lengthways axis which is parallel and close to the bottom of the hinge box. This, in itself, makes for a greatly decreased space need because the force producing unit is not placed at a slope in relation to the door and the free space over the force producing unit in the hinge box is used for taking up the support arm which is turned into the hinge box upon shutting the door.

The stop face may be placed on the front end face of the hinge box which is near to the frame of the piece of furniture or the like. Furthermore, the support arm may in cross-section take the form of a letter L with an angle of 90° between its two leg parts; this design produces the important useful effect in connection with having the stop or limiting face on the front side of the hinge box. Thus, the stop face, because of the hinge box being made of metal, is highly resistant to wear, since the support arm is made of metal as well. It is naturally possible furthermore for the hinge box to be made up of a highly wear-resistant, sturdy plastic composition. Furthermore, the stop or limiting face may itself be of a highly wear resistant part of synthetic resin which is embedded within the metal of the hinge box.

As a further development of the invention, the complete hinge box is made up of highly wear resistant synthetic resin material while, as part of a third development of the invention, the parts of the hinge box, where heavy wear is likely to take place, are to be made of metal parts, which are embedded or placed in a synthetic resin part of the hinge box.

As part of a further key-measure of the invention not only the support arm and force producing unit, but also the height adjustment system of the door hinge are placed and taken up within the space inside the hinge box in the shut position of the door. In this respect, the support arm may be made adjustable by its having a guiding face for slipping along another guiding face on the base plate fixed to the frame having the opposite form to the first-noted guiding face. Relative motion is possible because such guiding faces parallel to themselves. The guiding faces are also designed for producing a wedging effect when engaged, for example, by a set screw.

To make it possible for the hinge to be attached at any desired position on the front face of a piece of furniture, it is important that the face of the base plate which is forced against the front face of the piece of furniture, be further forward than the front face of the hinge box. That is to say, the hinge box is clear of the front face of the piece of furniture in the door's shut position.

As part of a further development of the present invention for fixing or mounting the guide face of the support arm against the guide face of the fixing or mounting plate, it is possible to make use of a gripping screw whose threaded part is taken up in the fixing plate, the screw running through a hole in the support arm.

This provides for the gripping screw with the parts of the fixing plate near it and the nearby parts of the support arm (guiding face) to be moved into the space within the hinge box in the shut position of the door hinge (compare FIGS. 1 and 10 of the drawings).

As part of a still further development of the invention, the guiding face of the support arm has a generally flat part which on two of its sides has legs sticking out from it towards the base plate. This has the effect of making a specially low price of production possible in the case of this height adjustment system. It furthermore is best for one of the legs to be designed as an angle or with a wedging effect for being taken up within a wedge-like groove in the guiding face of the fixing or base plate.

A short account will now be given of the useful effects produced by the present invention.

The hinge box is made of zinc or of plastics or of metal and plastics together having an integrated automatic system for keeping the door shut or moving it into a shut position. Unlike the structure of U.S. patent application Ser. No. 149,275, the turnpin of the hinge is set into the inside of the box by a certain amount, so that at the straight end face of the hinge box a land may be formed taking the form of a stop or limiting face acting against, or acted on by the support arm.

The support arm is made of metal by casting or stamping (zinc). In place of a tongue and groove guiding system, the support arm, because of its wide angle, bent form, may be the female part of the guiding system. The special form of the guiding face of the fixing or mounting base plate has a push-fit in relation to the guiding face of the support arm.

The fixing plate may be a cast metal part, made of brass or zinc alloy, or of a low-price part made by stamping sheet steel. The guiding face is formed between the outer radius of bending and the end face of the fixing or base plate.

Because the force producing unit generally is housed so as to be parallel to and near the bottom of the hinge box within the same, a different sort of system for locking the helical spring is necessary. The bolt of the force producing system has to be put into position from the back in a direction parallel to the bottom of the hinge box into the same. As a keeper for the helical spring and for shutting off the inlet end of the spring hole, use is made of a keeper pin which is slipped into a hole or a slot in the hinge box and locked in position in it.

In another form of the invention it is possible to make use, furthermore, of two pins in which respect the force producing unit will then be made up of two helical springs, placed side by side in parallel to each other, each with its own bolt for acting on the cam, and each helical spring will have its own backup or keeper pin. For keeping the backup pins in position, it is furthermore possible to make use of set screws which are screwed into the hole housing the spring. It would furthermore be possible to make use of bent-over sheet metal ears or thin pieces of the wall of the housing of the hinge box for keeping the spring backup pin or the helical springs directly in position.

The form and content of the present invention is to be seen not only in the structures of the separate claims, but furthermore in such measures as grouped together and acting in concert.

All measures and details of the invention as given in the present specification and claims, and more specially those to be seen in the figures as part of a three-dimensional structure, are claimed as a part of the invention inasmuch as, when taken separately, or grouped together, they are not disclosed by the prior art.

I claim:

1. In an improved pressure-operated door hinge for concealed door-closed mounting and limited outward swing opening of a door member with respect to a support frame member and which provides force to keep the door member in a desired position with respect to the frame member, a base plate adapted to be mounted on the frame member, a hollow hinge box adapted to be mounted within the door member from its back side adjacent a side edge thereof, a connecting swing arm of angle shape having a pair of mounting end portions, one of said end portions extending from within said box and having a cam face pivotally mounted therein, means mounting the other of said end portions on said base plate, said box having a bore wall therein, extending along the inside thereof and being open at its inner front end within said box and open at its outer back end outside of said box, spring-pressed latch means extending in an operatively mounted relation along said bore wall within said box and from the inner front open end of said bore wall into operative engagement with said cam face, said latch means being introduced into an operating relation within said bore wall from the outer back open end thereof, and cross-extending keeper pin means carried in a transverse hole in a back end of said box to extend across the outer back open end of said bore wall and engage a back end of said latch means to securely hold said latch means in an operating position within said bore wall.

2. An improved door hinge as defined in claim 1 wherein screw means removably-adjustably mounts said other end portion of said swing arm on said base plate.

3. An improved door hinge as defined in claim 1 wherein, said box has a pair of open end bore walls of the defined construction and mounting in a transversely spaced apart relation within said box, spring-pressed latch means of the defined construction is provided for and positioned within each of said bore walls to extend from the front open ends thereof into engagement with said cam face, and said keeper pin means removably extends across the back end of said box and each of said bore walls into position-retaining engagement with the outer back end of each of said latch means.

4. An improved door hinge as defined in claim 1 wherein, said hinge box is adapted to swing on said one portion of said swing arm from a substantially parallel closed position with respect to said base plate and the frame to an outwardly open angular relation with respect thereto, and said swing arm and an adjacent front end of said box have cooperating abutment faces for limiting the maximum outward open swing of the door member to an angular-spaced position with respect to the frame member.

5. An improved door hinge as defined in claim 4 wherein the abutment face of said swing arm is carried by said one end portion thereof, and the abutment face of said hinge box extends substantially perpendicular with respect to the back side of the door.

6. An improved door hinge as defined in claim 1 wherein, adjustment screw means is adapted to mount said other end portion of said swing arm on said base plate, and said swing arm and said box have cooperating abutment faces for limiting the maximum outward open back swinging position of the door member with respect to the frame member.

7. In an improved pressure-operated door hinge for concealed door-closing mounting and limited outward swing opening of a door member with respect to a support frame member and which provides for keeping the door member in a desired position with respect to the frame member, a base plate adapted to be mounted on the frame member, a hollow hinge box adapted to be mounted within the door member from its back side adjacent an open edge thereof, a connecting swing arm of angular shape having a pair of mounting end portions, one of said end portions extending from within said box and having a cam face pivotally mounting it therein, means mounting the other of said mounting end portions on said base plate, said box having a bore wall therein extending along the inside thereof and being open at an inner front end thereof within said box, spring-pressed latch means extending in a mounted relation along said bore wall within said box and from the front open end of said bore wall into operative engagement with said cam face, said hinge box being adapted to swing on said one portion of said swing arm from a substantially parallel closed position with respect to said base plate and the frame to an outwardly open angular relation with respect thereto, and said one end portion of said swing arm and an adjacent end portion of said box having cooperating abutment faces for limiting the maximum outward open swing of the door member to an angular-spaced position with respect to the frame member.

* * * * *